US006817868B2

(12) United States Patent
Matsuo et al.

(10) Patent No.: US 6,817,868 B2
(45) Date of Patent: Nov. 16, 2004

(54) INTERMEDIATE BOARD ELECTRICAL CONNECTOR

(75) Inventors: Tsutomu Matsuo, Tokyo (JP); Tatsuya Arai, Tokyo (JP)

(73) Assignee: Hirose Electric Co., Ltd., Kanagawa-ken (JP)

( * ) Notice: Subject to any disclaimer, the term of this patent is extended or adjusted under 35 U.S.C. 154(b) by 0 days.

(21) Appl. No.: 10/273,919

(22) Filed: Oct. 21, 2002

(65) Prior Publication Data

US 2003/0077922 A1 Apr. 24, 2003

(30) Foreign Application Priority Data

Oct. 23, 2001 (JP) ..... 2001-325217

(51) Int. Cl.[7] ..... H01R 9/09
(52) U.S. Cl. ..... 439/65
(58) Field of Search ..... 439/65, 70, 76.1, 439/79, 80

(56) References Cited

U.S. PATENT DOCUMENTS 4,200,347 A * 4/1980 Sinclair et al. ..... 439/70
5,522,727 A * 6/1996 Saito et al. ..... 439/65
5,924,899 A * 7/1999 Paagman ..... 439/701
6,123,554 A * 9/2000 Ortega et al. ..... 439/79
6,171,115 B1 * 1/2001 Mickievicz et al. ..... 439/76.1
6,338,631 B1 * 1/2002 Hashimoto et al. ..... 439/79
6,517,360 B1 * 2/2003 Cohen ..... 439/65
6,655,966 B2 * 12/2003 Rothermel et al. ..... 439/76.1

FOREIGN PATENT DOCUMENTS

| | | |
|---|---|---|
| EP | 0644628 A | 3/1995 |
| JP | 7-6823 | 1/1995 |
| JP | 7-85938 | 3/1995 |
| JP | 07085938 A | 3/1995 |

* cited by examiner

*Primary Examiner*—Thanh-Tam Le
(74) *Attorney, Agent, or Firm*—Takeuchi & Takeuchi

(57) ABSTRACT

An intermediate board electrical connector comprises a circuit board having two non-parallel straight edges, a plurality of connections sections (12 and 13) arranged along the straight edges at regular intervals, and a plurality of wiring conductors (14) connecting the corresponding connection sections (12 and 13). The connection sections (12 and 13) are connected to connectors (20 and 30), respectively.

6 Claims, 6 Drawing Sheets

INTERMEDIATE BOARD ELECTRICAL CONNECTOR

BACKGROUND OF THE INVENTION

1. Field of the Invention

The present invention relates to an electrical connector, especially, to an intermediate board electrical connector to connect connectors arranged at right angles to each other. This intermediate board electrical connector is referred to as a right angle connector.

2. Description of the Related Art

The connector of this type is known, for example, by a disclosure in Japanese Unexamined Patent Publication No. 7-6823. As illustrated in FIG. 5, in this publicly known connector 50, a plurality of circuit boards 52 are inserted and arranged in a rectangular pipe housing 51 so as to be parallel to each other. Each circuit board 52 has its front edge located in the front opening of the housing, while its back portion protrudes from the backside of the housing 51 and has its bottom edge at the same level as the lower surface of the housing. Line patterns or conductors 53A, 53B, 53C, 53D are provided on a surface of the circuit board 52 by printed wiring. Those line patterns respectively connect to connection sections 54A, 54B, 54C, 54D at the front edge of the circuit board 52, while those line patterns respectively connect to leg-shaped connection sections 55A, 55B, 55C, 55D at the bottom edge of the circuit board 52.

At the time of use, the connection sections 55A, 55B, 55C, 55D are connected with their corresponding circuit sections on a circuit board (not illustrated) via soldering or the like. The connector to be connected (not illustrated) is first brought to engage, and then connected with the connection sections 54A, 54B, 54C, 54D. By doing this, the circuit board connects with the other connector, which is located vertically to the circuit board, via the connector 50. For using this connector 50 for high-speed transmission, however, delay of signal is occurred due to the different transmission path lengths of line patterns 53A, 53B, and 53C, 53D.

To provide such right angle connector which has same transmission path length, Japanese Unexamined Patent Publication No. 7-85938 suggests the one as illustrated in the accompanied figure, FIG. 6. The connector illustrated in FIG. 6 has a plurality of parallel contacts 63, which connect to carriers 61, 62 which are parallel to each other. After covering both surfaces of those contacts 63 with a flexible thin insulating sheet material 64, the contacts 63 and the insulating sheet material are bent along a 45° line 65 with respect to the contacts 63, and overlaid. Thereafter, the contacts 63 are supported by an L-shape molded supporting material between the sheet material 64 and the carriers 61, 62. Then, the carriers 61, 62 are separated from the contacts 63 at the positions 66, 67. By doing this, all the contacts have same length, and are L-shaped so as to form the right angle connector.

Even in the connector of FIG. 6, however, there are some problems. First, since the thin insulating material is selected for its bending, even the prepared connector still has low rigidity and is difficult to handle. Also, since the contact is formed by bending, the contact could be broken during a process or use. The process of preparing the contacts is troublesome because it includes process of adhering them to an insulating sheet and bending them together with the insulating sheet, and even it further includes a mold forming process. Although both surfaces of each contact are covered with the insulating sheet, it is still not preferable for its electrical properties to have a partially overlapping structure.

SUMMARY OF THE INVENTION

Accordingly, it is an object of the present invention to provide an intermediate board electrical connector which can be easily prepared, easily handled, and is superior in electrical properties.

On the intermediate board electrical connector of the present invention, a plurality of connection sections are provided on at least one side of a circuit board, such that the connection sections are arranged with specified intervals along two straight edges, which are not parallel to each other. Those connection sections along one edge are connected to the corresponding connection sections along the other edge via line patterns or conductors, and the contact sections along each edge can be respectively connected with other connector.

In the present invention, the intermediate board electrical connector is featured by having same length of line patterns. According to the present invention of such constitution, since the plurality of line patterns of the intermediate board electrical connector has same length, the transmission path lengths between the corresponding connection sections are all the same; therefore it is ideal for high-speed transmission. In the present invention, the two straight edges, which are not parallel to each other, can be substantially vertical to each other. In many cases, two connectors are connected in substantially vertical positions. Also, one of the two straight edges is made to protrude outward than the other straight edge, so that the connector has a widthwise part and lengthwise part. According to this structure, the device, in which the connector is used, can be made small, especially it can be made to be lower-profile.

DESCRIPTION OF THE PREFERRED EMBODIMENTS

Figure 1:
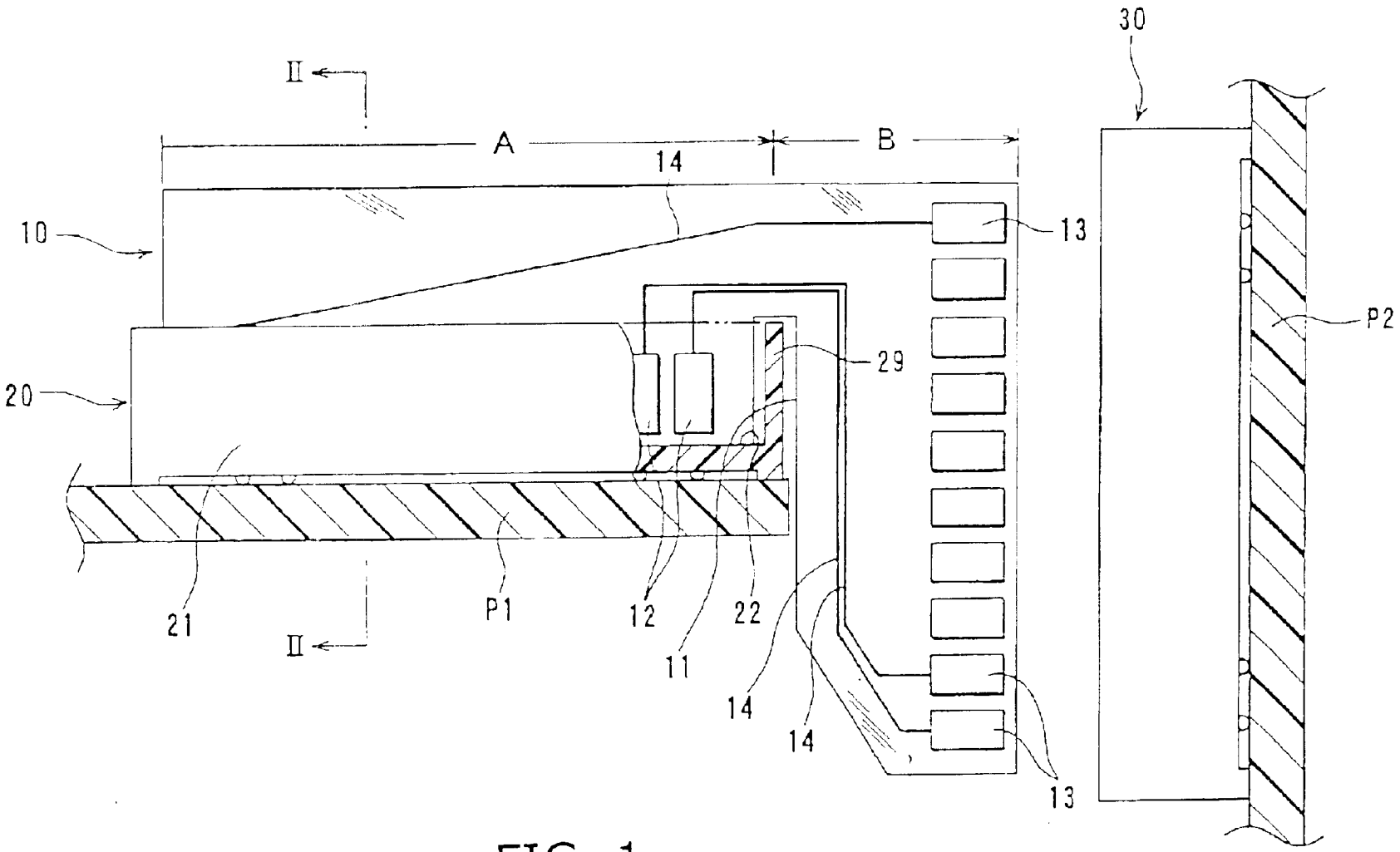
FIG. 1 is a front view of an intermediate board electrical connector according to an embodiment of the present invention.

In FIG. 1, the intermediate electrical connector 10 is used to connect two connectors 20, 30, which are arranged at right angles to each other. The intermediate electrical connector 10 is made as a circuit board, which is parallel to the paper surface of the figure. In a case of the example illustrated in FIG. 1, it has a widthwise or horizontal part A and lengthwise or vertical part B. And a slot 11 extending to the middle point in the lengthwise direction of the figure is formed at the boundary between those two parts A and B.

In the intermediate board connector 10, same number of a plurality of connection sections 12, 13 are respectively provided along a straight lower edge of the widthwise part A and a straight right edge of the lengthwise part B at specified intervals. Those connection sections 12, 13 are formed as pads on a circuit board material made of insulating material by using printed wiring technology. The connection sections 12 at the widthwise part A and the connection sections at the lengthwise part B are connected by connecting corresponding connection sections at both straight edges via a plurality of line patterns or conductors 14. Those line patterns 14 are different in their paths and shapes, but they are same in their path length. In other words, since all the line patterns have same path length, their paths and shapes are different. The line patterns 14 can be formed by printed wiring in similar to the connection sections 12, 13. The connection sections 12, 13 and the line patterns 14 can be provided on both sides of the circuit board, or only on one side.

In this embodiment, identical connectors are used as the connector 20 and the connector 30. Therefore, only the connector 20 is described below, and the description of the connector 30 is omitted. The connector 20 has a widthwise rectangular parallelepiped housing 21. The housing 21 has a slot-shaped receiving dent 22 to insert a portion of the intermediate board electrical connector 10, where the connection sections 12 of the widthwise part A are provided.

Figure 2:
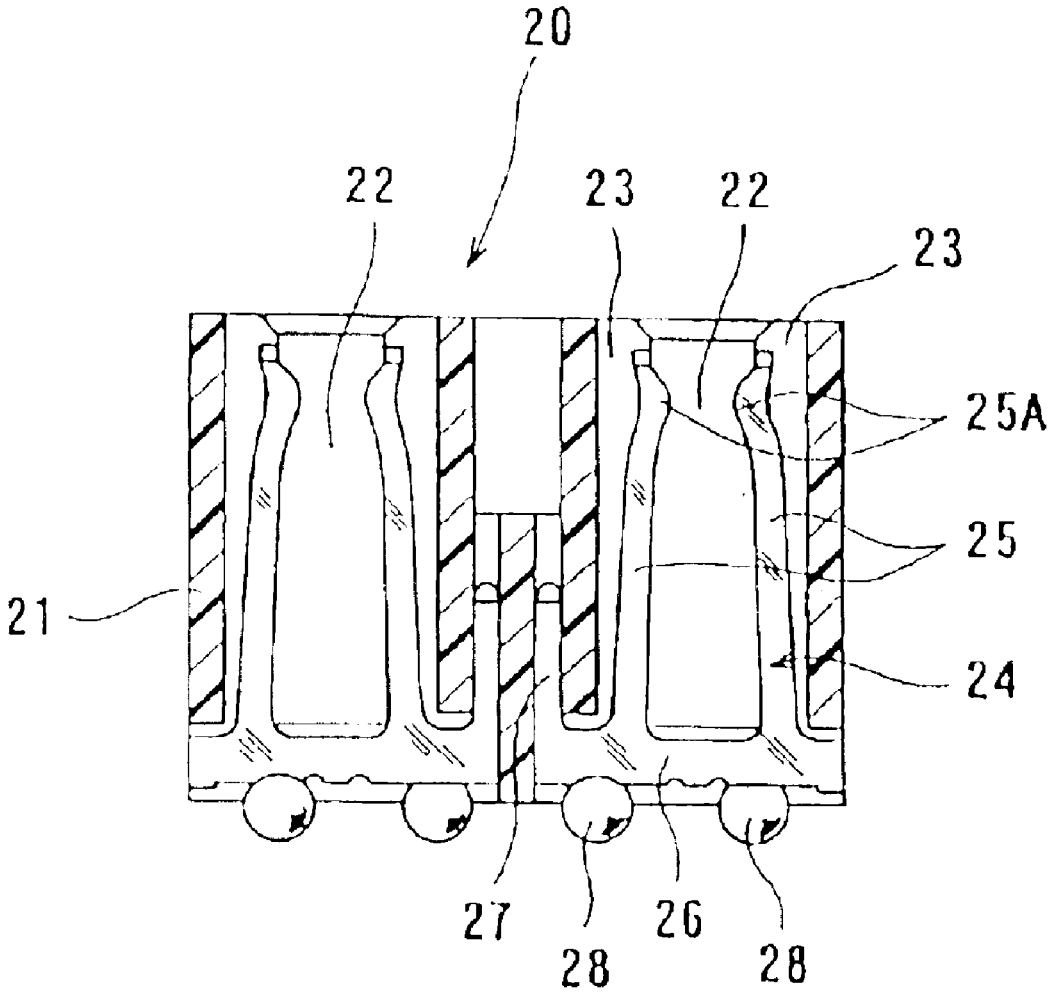
FIG. 2 is a sectional view taken along line II—II of FIG. 1.

In FIG. 2, the housing 21 has two receiving dents 22, so that two intermediate board electrical connectors 10 can be inserted therein. In the housing 21, a pair of terminal receiving slot 23 is respectively formed along the two facing inner surface of the housing for each receiving dent 22. A plurality of pairs of the terminal receiving slot 23 are formed at a specified interval in a direction vertical or perpendicular to the surface of the figure, FIG. 2. The terminal receiving slot 23 is opened to the lower surface of the housing 21, so that the terminal 24 can be inserted from the lower surface towards the terminal receiving slot 23.

The terminal 24 is prepared by punching a metal sheet parallel to the paper surface of FIG. 2, maintaining its flat surface. The terminal 24 has a pair of contact arms 25, which extend upward and have elasticity, a connection section 26 which is joined to both contact arms 25 at their lower ends, and a fixing arm 27 which shortly extends upward from one end of the connection section. The pair of the contact arms 25 are bent in directions adjacent each other in upper portions, and form the contact sections 25A by their closely positioned sections. The fixing arm 27 is pressed into a specified slot of the housing and prevents the terminal from sliding out. Also, the connection section 26 faces to the lower surface of the housing, and solder balls 28 are provided along the lower edge of the connection section 26. In a case of the illustrated example, the solder balls 28 are provided slightly being shifted right/left from adjacent two terminals. Also, it is designed not to have trouble to mount the solder balls even in a case that the intervals of the arrangement of the plurality of the terminals is small.

The connector 30 has the same constitution as that of the connector 20 only except the following point. That is, as illustrated in FIG. 1, widthwise circuit board P1 is connected to the connector 20, while the lengthwise circuit board P2 is connected to the connector 30. In the present invention, the connectors 20, 30 are not required to have specific features, and can have terminals of different forms. Therefore, any further details of those connectors are not described in this specification.

The intermediate board electrical connector of this embodiment is used in the following manner.

(1) First, connect the connectors 20, 30 to respective circuit board P1, P2 of the corresponding devices. As for connection, melt the solder balls 28 by hot air, and then solder to the specified circuit portion.

(2) In next, as illustrated in FIG. 1, connect the intermediate board electrical connector 10 to one of the connectors, e.g. connector 20. The connection section 12 of the intermediate board electrical connector 10 is tightly pressed by the pair of the contact sections 25A of the connector 20 so as to be connected. At this time, the slot 11 of the intermediate board electrical connector 10 is used to receive the terminal walls 29 of the connector 10.

(3) Then, move the intermediate board electrical connector 10 together with the circuit board P1 rightward in FIG. 1, and insert the connection sections 13 of the lengthwise part B into the connector 30, so that the connection is completed.

(4) Thus, the two connectors 20, 30 are electrically connected through the connection of the corresponding terminals via the intermediate board electrical connector. At this time, since the path lengths of the plurality of the line patterns 14 are all equal in the intermediate board electrical connector 10, the transmittance path lengths are the same between any corresponding terminals in the two connectors, so that satisfactory high-speed transmission properties can be obtained.

Figure 3:
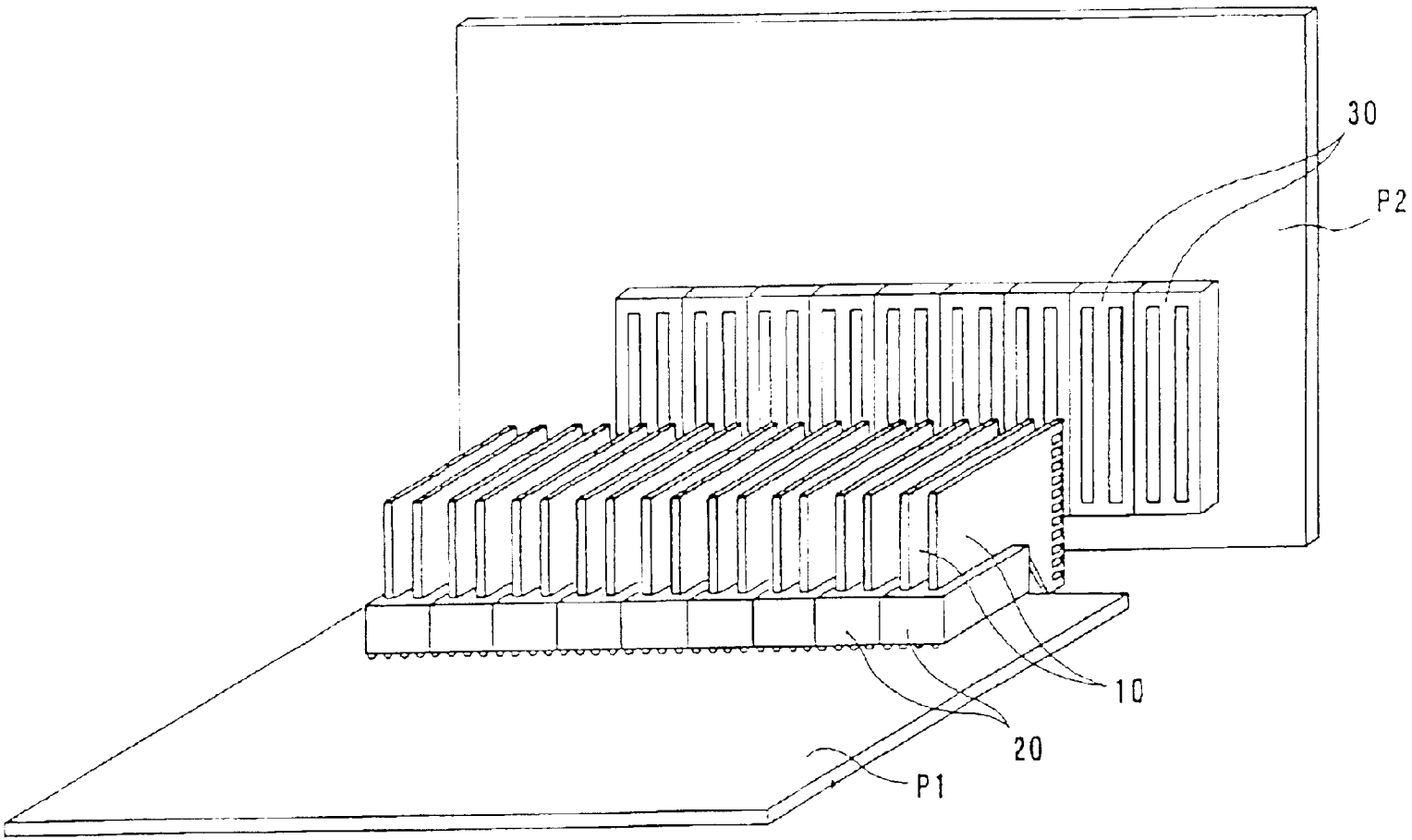
FIG. 3 is a perspective view of the intermediate electrical connector connected to the connectors that are mounted on a board.
Figure 4:
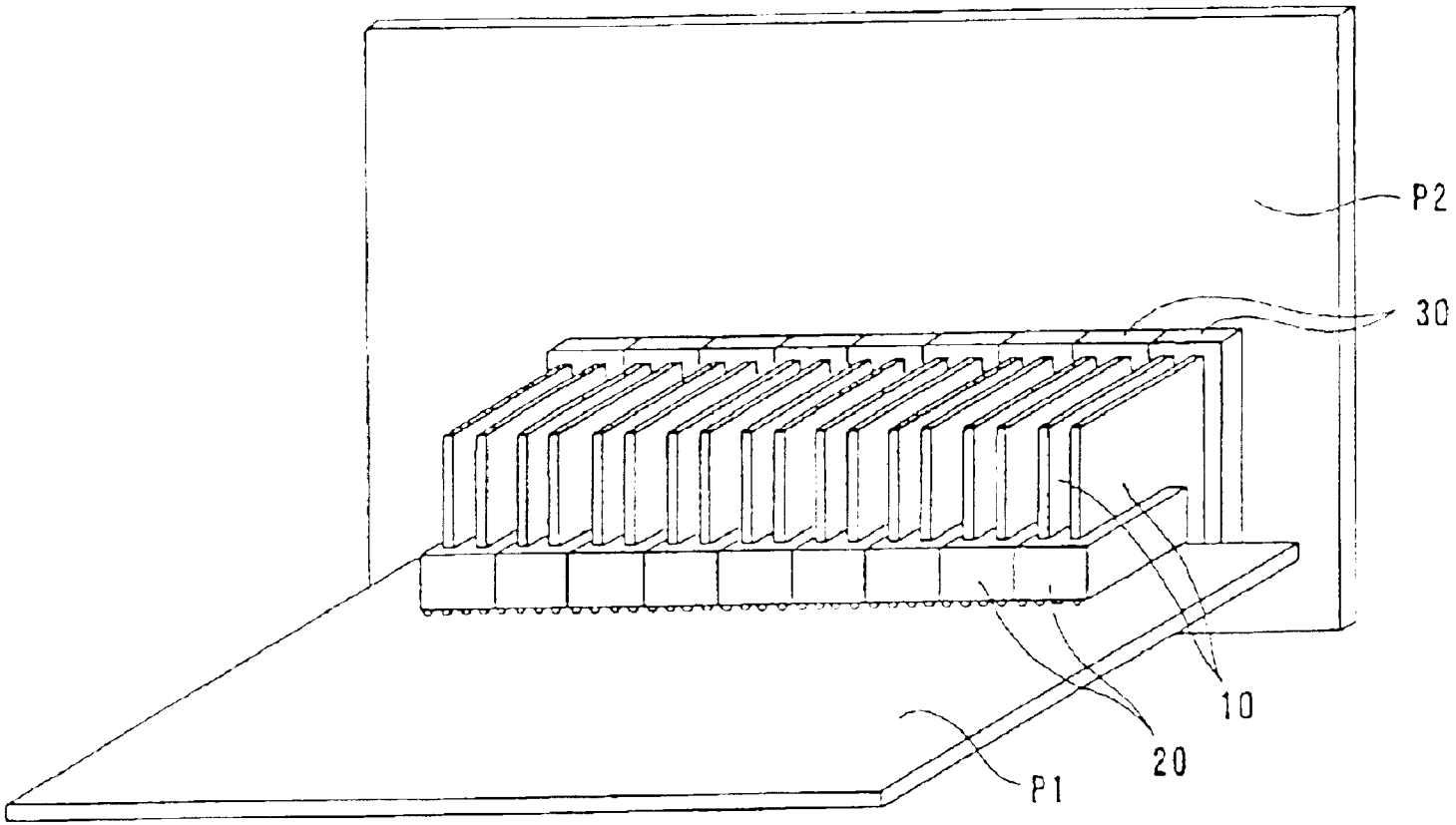
FIG. 4 is a perspective view of the intermediate electrical connector connected to the connectors that are mounted on both of the boards.
Figure 5:
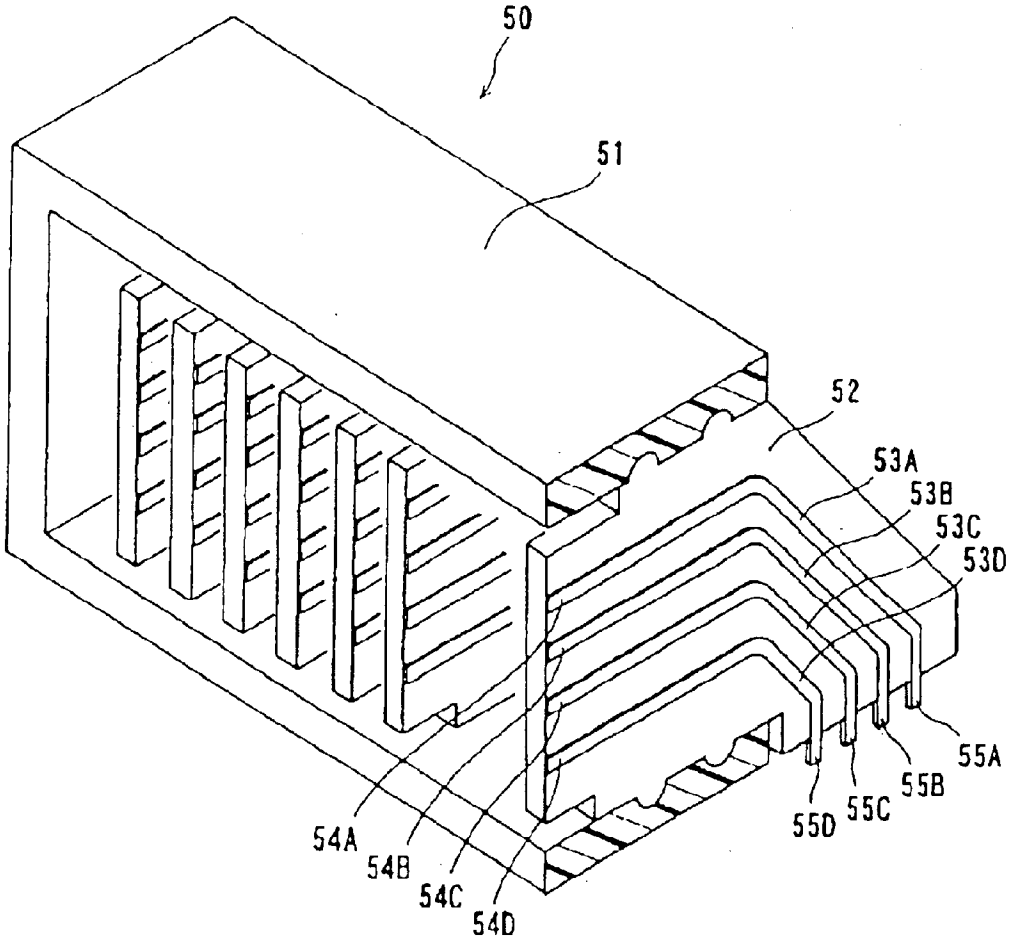
FIG. 5 PRIOR ART
FIG. 5 is a perspective view of the conventional connector.
Figure 6:
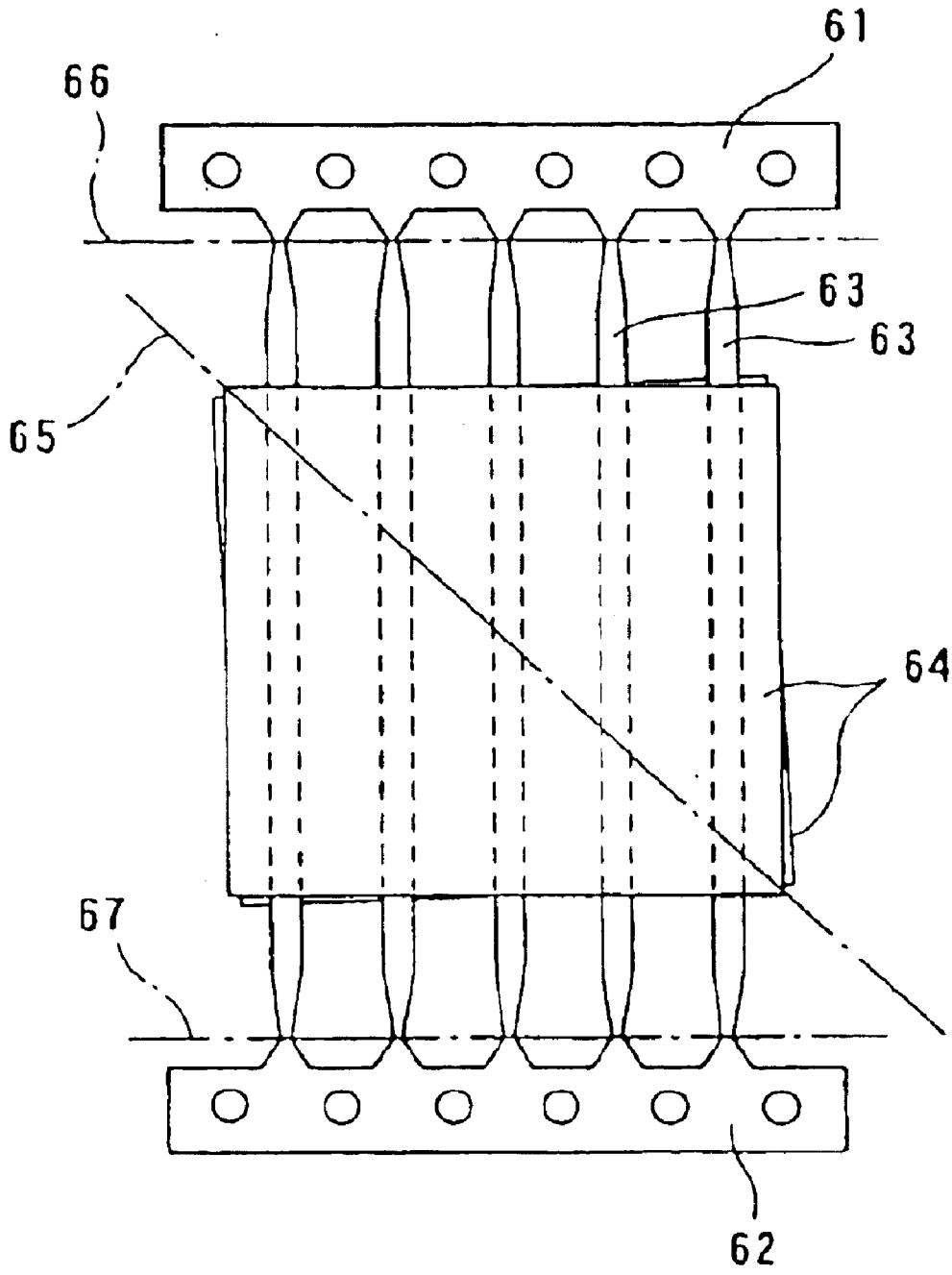
FIG. 6 PRIOR ART
FIG. 6 is a plan view of the intermediate product of the terminal member of another conventional connector.

As illustrated in FIGS. 3 and 4, even a plurality of the connectors 20, 30, which can be connected via such intermediate board electrical connectors 10. In FIG. 3, a plurality of connectors 20 are arranged continuously on the circuit board P1, while a plurality of connectors 30 are arranged continuously on the circuit board P2. The intermediate board electrical connectors 10 are inserted into all the plurality of connectors 20, and then this connected structure can be connected to the plurality of the connectors 30 at once, as illustrated in FIG. 4. Accordingly, since a plurality of the connectors can be arranged, the number of poles can be optional depending on the selected number of the connectors.

The present invention is not limited to the one illustrated in the figures, and various modifications are possible. For example, the number of the intermediate board electrical connectors inserted and connected can be one or three or more, by changing the structure of the connector. In addition, the two connectors connected by the intermediated board electrical connector do not have to be vertical to each other, but can be tilted for a certain angle. Moreover, in the case illustrated in FIG. 1, the intermediate board electrical connector extends in a length direction such that the lengthwise portion uses an area in the height direction of the widthwise portion, so that the overlapping area between the lengthwise portion and the widthwise area contributes for making the device small or making the device short. However, if there is no requirement to make the device small or lower-profile, it can be simply designed as L-shaped or rectangular shape.

Furthermore, when the form of the line patterns on the intermediate board electrical connector becomes more complicated or dense, a multi-layered structure can be possible, by including an insulating layer between line patterns. A coating layer can be formed on the surface layer to protect the circuit surface (line pattern).

As described above, the present invention is designed such that the plurality of the connection sections are connected by connecting corresponding pair of connection sections by same length of line patterns. Here, the connection sections are provided along the two straight edges, which are not parallel to each other on the circuit board, at specified intervals. Therefore, the intermediate connector can be easier to handle due to the rigidity of the board, and simultaneously ideal for high-speed transmission due to the same transmission path lengths. Moreover, it can be manufactured easily and at lower cost only by printed wiring technology.

What is claimed is:

1. An intermediate board electrical connector, comprising:

a circuit board having first and second straight edges, which are not parallel to each other, and detachably attached to first and second connectors having terminals for electrical connection with said circuit board;

a plurality of first and second connection sections provided at a specified interval along said first and second straight edges, respectively, and electrically connected to said terminals of said first and second connectors, respectively; and a plurality of line conductors to connect said first connection sections to said corresponding second connection sections, wherein said first and second connection sections are arranged in such an order that said line conductors do not cross each other and lengths of said line conductors are equal.

2. The intermediate board electrical connector of claim 1, wherein said first and second straight edges are substantially at right angles to each other.

3. The intermediate board electrical connector of claim 1, wherein one of said first and second straight edges protrudes outward more than the other straight edge such that said intermediate board electrical connector has a widthwise part and a lengthwise part.

4. The intermediate board electrical connector of claim 1, wherein said first and second connection sections are provided on the same side of said circuit board.

5. The intermediate board electrical connector of claim 1, which further comprises a slot provided between a row of said first connection sections and a row of said second connection sections for supporting a side wall of said first or second connector.

6. An intermediate board electrical connector assembly, comprising:

at least one said intermediate board electrical connector according to claim 5; and at least one said first connector and at least one said second connector, wherein said side wall of said first or second connector is supported in said slot of said intermediate board electrical connector.

* * * * *